United States Patent [19]

Howden et al.

[11] 4,410,279

[45] Oct. 18, 1983

[54] APPARATUS FOR AGITATING THE CONTENTS OF STORAGE TANKS

[75] Inventors: Michael Howden, Appleton; Terence L. Griffiths, St. Helens, both of England

[73] Assignee: British Nuclear Fuels Limited, Risley, England

[21] Appl. No.: 358,832

[22] Filed: Mar. 16, 1982

[30] Foreign Application Priority Data

Mar. 31, 1981 [GB] United Kingdom ..... 8110079

[51] Int. Cl.[3] ..... B01F 7/32

[52] U.S. Cl. ..... 366/262; 415/63; 366/264; 366/265; 366/263

[58] Field of Search ..... 366/150, 262, 263, 264, 366/265, 266, 270, 54, 56, 60, 235, 224, 295, 299, 61, 211, 249, 250, 282; 184/6.18; 415/110, 112, 213 A, 62, 63, 83; 416/174

[56] References Cited

U.S. PATENT DOCUMENTS

| | | | |
|---|---|---|---|
| 685,967 | 11/1901 | Boovist | 415/63 |
| 2,770,123 | 11/1956 | Walton | 366/265 |
| 2,875,897 | 3/1959 | Booth | 366/264 |
| 3,062,515 | 11/1962 | Green | 366/61 |
| 3,589,840 | 6/1971 | Murphy | 415/63 |
| 3,606,273 | 9/1971 | Johnson | 366/263 |

*Primary Examiner*—James E. Bryant, III
*Assistant Examiner*—Kwon John
*Attorney, Agent, or Firm*—William R. Hinds

[57] ABSTRACT

An apparatus for agitating and transforming settled sludges into slurries which are then capable of being pumped by conventional means. The apparatus comprises a housing immersible in the contents of a tank or chamber and containing separate variable drive means for an impeller and an impeller casing. The impeller casing forms an inlet to the impeller and has a plurality of radially directed outlet nozzles whereby rotation of the impeller effects circulation of the contents of the tank or chamber from the inlet to the outlets and rotation of the casing causes the discharge at the outlets to agitate the contents. The discharge at the outlets breaks up solid sediment at the bottom of the tank or chamber and a continuous recirculation of the contents results in the formation of a slurry.

5 Claims, 2 Drawing Figures

4
25
3
10
33
18
14
22
21
15
8
24
24
5
9
6
7

1
2
3
4
5
7
8
9
10
11
12
13
14
15
16
17
18
19
20
21
22
23
24
26
27
28
29
30
31
32
33
34
35
36
37
38
39
40
41
42

APPARATUS FOR AGITATING THE CONTENTS OF STORAGE TANKS

The present invention concerns an apparatus for agitating the contents of storage tanks and for transforming settled sludges into slurries.

The emptying of a storage tank containing a sediment or sludge and a supernatant liquid requires agitating the contents of the tank to form a slurry which can then be handled by an appropriate retrieval system, such as a centrifugal pump. In many instances storage tanks can contain instrumentation, heating or cooling conduits and the like which prohibit the use of vanes, paddles and the like for agitating and stirring the contents.

According to the present invention an apparatus for agitating the contents of storage tanks comprises a housing immersible in the contents of the tank, the housing containing respective variable drive means for rotating an impeller and an impeller casing, the impeller and impeller casing extending beyond an end of the housing and being exposed to the contents of the tank, the casing forming an inlet to the impeller and having a plurality of radially directed outlet nozzles whereby rotation of the impeller effects circulation of the contents from the inlet to the outlets and rotation of the casing causes the discharge at the outlets to agitate the contents of the tank.

The contents of the tank can be a solid sediment covered by a liquid medium. Initially on actuation of the drive means the liquid medium is drawn in through the inlet to be expelled through the outlets which can be directed to break-up the solid sediment at the bottom of the tank. In time the solid sediment is effectively suspended in the liquid medium as a result of the continuous circulation of the contents to form a slurry which can then be removed from the tank by a separate system.

The drive means are isolated from the contents of the tank and a separate liquid flow means, maintained at a pressure greater than the pressure of the environment within the tank, can be provided to create barriers against ingress of the contents into the interior of the housing containing the drive means, associated bearings and seals. Conveniently this separate liquid flow means is water.

A movable carriage, located outside of the tank, can be provided for coupling to the apparatus and having power and ancillary service plant for the operation of the apparatus.

Figure 1:
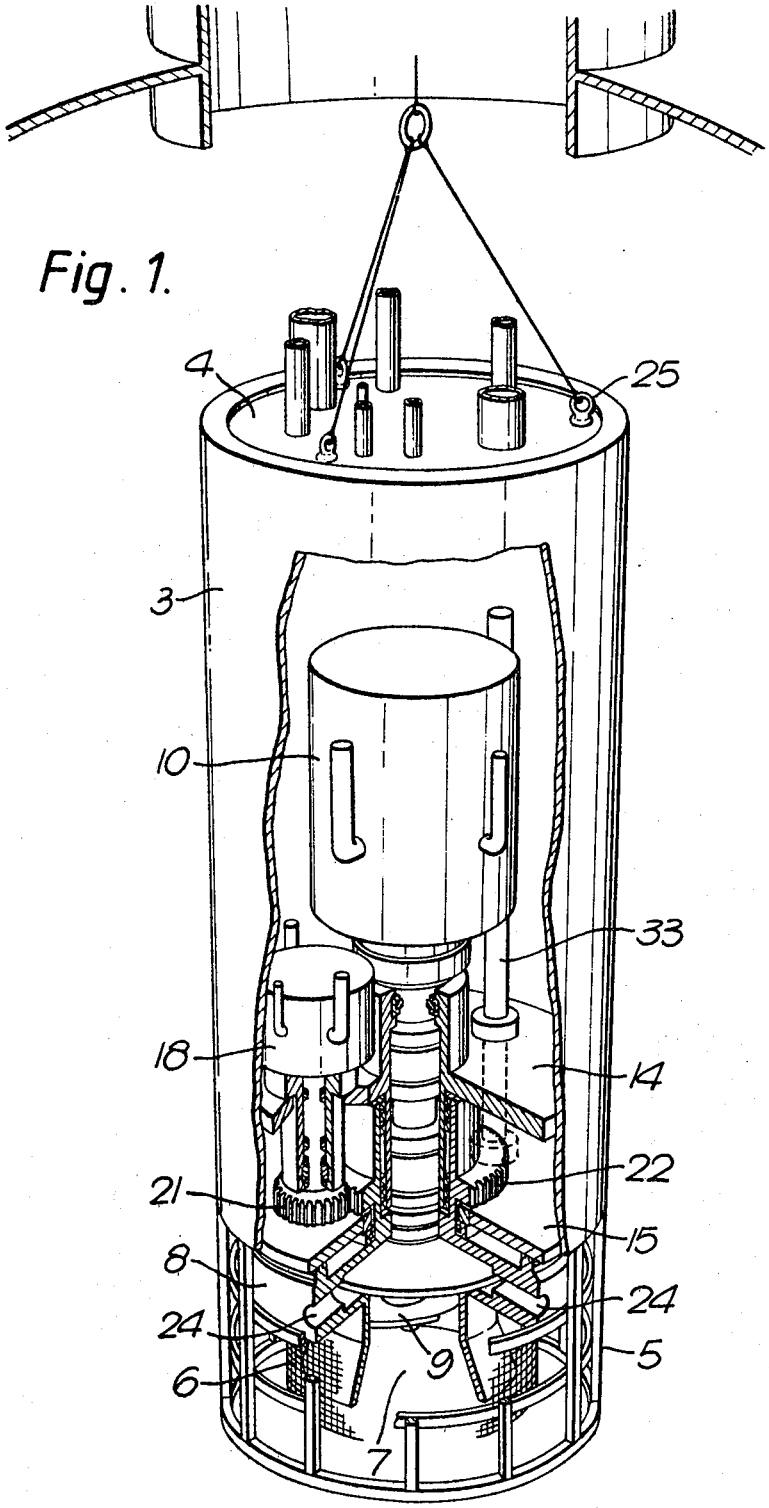
Figure 2:
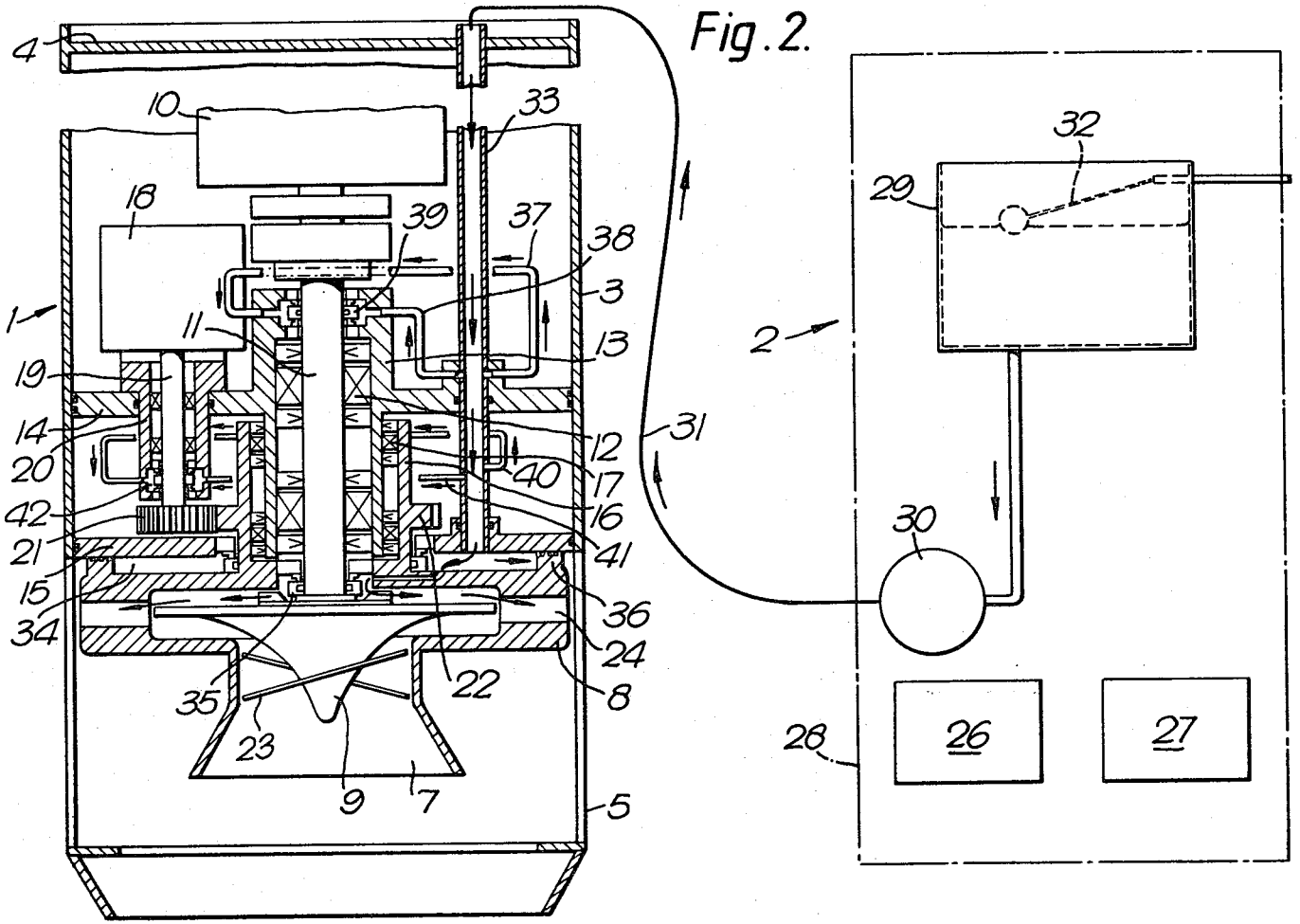

The invention will be described further, by way of example, with reference to the accompanying drawings; in which FIG. 1 is a cutaway view of an embodiment of an apparatus for agitating the contents of storage tanks; and FIG. 2 is a schematic diagram of the apparatus, in section and showing associated operating equipment which is located outside the tank.

The apparatus comprises a pump head 1 which is adapted to be suspended within a tank containing a sludge to be fluidised and a portable unit 2 located outside the tank and carrying power and service plant for the operation of the head. The roof of the tank, having an opening for the pump head, is shown in FIG. 1.

The pump head 1 comprises a cylindrical housing 3, preferably stainless steel, which is closed at its upper end by a lid or cover 4. The opposite lower end of the housing 3 carries an open, stainless steel framework 5 which houses and protects a mesh basket 6, the latter being arranged about pump inlet 7, a rotatable impeller casing 8 and pump impeller 9.

The impeller 9 is driven by a hydraulic drive motor 10, conveniently a swash plate motor, and capable of operation at variable speed. The drive motor 10 is coupled to the impeller 9 by a stainless steel drive shaft 11 mounted vertically in a system of bearings and seals 12 which are located in a shaft housing 13. The housing 13 is supported within the housing 3 by means of an integral flange plate 14 which is secured to the wall of the housing 3.

The impeller casing 8 is located below a further plate 15 which forms a bottom closure for the housing 3. A boss 16 on the casing 8 extends upwardly through the plate 15 and is rotatably supported on the shaft housing 13 by a system of bearings and seals 17.

A hydraulic drive motor 18, conveniently a hydraulic gear motor operable at a variable speed, is mounted on and above the flange plate 14. A drive shaft 19 of the motor 18 is journalled within a bearing sleeve 20 and terminates in a gear wheel 21 which meshes with a gear ring 22 on the boss 16 of the casing 8 whereby to rotate the casing 8.

The impeller drive shaft 11 projects through the centre of the bottom plate 15 and the impeller 9 is mounted in position on the end of the shaft 11. A secondary impeller or inducer 23 can be provided to initiate a priming flow of liquid to the main impeller at the commencement of start-up.

The impeller casing 8 is formed with radial discharge nozzles or jets 24 which can be arranged normal to or inclined at an angle to the axis of rotation of the impeller. Conveniently, the casing 8 can be provided with 3 equiangularly spaced nozzles or jets 24.

Lugs 25 for lifting and lowering the apparatus into and out of the tank containing sludge are fitted to the lid 4 of the housing 3. The lugs are linked by internal tie rods (not shown) to the flange plate 14 such that the weight of the apparatus is carried by the flange plate and not by the housing 3.

Respective hydraulic drive units for the motors 10 and 18 are diagrammatically illustrated by the reference numerals 26 and 27. The units 26 and 27 can be mounted on a movable carriage 28 which is arranged outside the tank and the units are coupled to the motors 10 and 18 by transmission hoses or pipes which pass through the lid 4 of the casing 3 and as indicated in FIG. 1. Preferably, the carriage should be located as near to the tank as possible in order to minimise the lengths of the transmission hoses or pipes.

The carriage 28 further supports a reservoir 29 of clean water and a pump 30 which pumps the water through a flexible hose 31. The reservoir 29 can be replenished with water by means of a conventional ball valve arrangement 32. The hose 31 is coupled to a manifold 33 which extends through the lid 3, the flange plate 14 and the plate 15 to feed water to an annular chamber 34 between the lower surface of the plate 15 and the upper surface of the impeller casing 8. A supply of water from the chamber 34 is directed about a seal 35 at the end of the impeller drive shaft 11 to flow outwardly from the casing through the nozzles 24. A labyrinth seal 36 is provided at the outer boundary of the chamber 34 and between the impeller casing 8 and the lower surface have the plate 15. This seal is fitted in a manner to permit a small outflow of water.

Branch conduits 37 and 38 direct water from the manifold 33 to an axial mechanical seal 39 about the drive shaft 11 of the motor 10. Further branch conduits 40 and 41 direct water to an axial mechanical seal 42 about the drive shaft 19 of the motor 18. The water flows are indicated by the arrow heads in FIG. 2.

In operation, the water is pumped continuously into the head 1 at a pressure which is greater than any external pressure to be encountered by the head. This pressure difference causes a continuous outflow of water from the chamber 34 to prevent sludge reaching the seal 35 at the end of the impeller drive shaft 11. The water leakage across the seal 36 acts as a barrier to the sludge at the lower surface of the plate 15. The pressure water applied to the seals 39 and 42 lubricates these seals and forms secondary barriers to the passage of sludge about the drive shafts of the motors.

The hydraulic motors 10 and 18 are isolated from the hostile environment of the sludge by the flange plate 14.

In use, the pump head 1 is lowered into the tank containing a settled sludge, that is a solids deposit at the bottom of the tank and covered by a liquid medium. The pump head 1 is immersed in the liquid medium and operation of the impeller drive motor 10 causes the impeller to rotate whereby liquid in the tank is drawn through the inlet 7 and expelled through the nozzles 24. At the same time the impeller casing drive motor 18 is actuated to rotate the casing 8 such that the liquid issuing from the nozzles 24 is distributed over 360°. The speeds of the motors 10 and 18 are variable and the flow through the nozzles and the speed of rotation of the nozzles can be optimised to suit the contents of the tank. The liquid issuing from the nozzles will break-up and mix with the surface layers of the sludge to form a slurry. This slurry is in turn drawn into the impeller and expelled through the nozzles to continue the break-up of the sludge. This process continues until the solid sludge is transformed into a slurry in the tank and the head 1 can be lowered progressively during break-up of the sludge. The slurry so formed can be removed from the tank by a separate pumping system, such as a centrifugal pump or a jet pump.

The head 1 is capable of withstanding severe operating conditions such as obtaining in the nuclear industry where the sludge can be both radioactive and abrasive. It can be arranged that parts of the impeller casing which are liable to severe abrasion during operation can be removed and replaced as necessary. The impeller and inducer are fabricated from material which has a high resistance to abrasion. Further the impeller, inducer and impeller casing can be provided with protective coatings to combat specific operational environments. On account of the abrasive nature of the slurry it is necessary to prevent entry of the slurry into the internal components of the head such as the seals and bearings. The continuously pumped water at a pressure higher than the pressure within the tank provides barriers to the entry of the slurry and further serves to lubricate the bearings. The motors 10 and 18 are isolated within the housing 3 by the flange plate 14 and likewise the components located between the flange plate 14 and the plate 15 are isolated from the impeller. Warning devices can be provided as a safe guard to indicate if any sludge enters the housing 3.

The head 1 can be made as a compact assembly having for example a diameter of about 75 cms and a length of approximately 250 cms.

The head is suitable for insertion within tanks which can contain instrumentation or facilities which could prohibit the use of paddles, vanes and the like for agitating the sludge.

It will be appreciated that it is possible to modify the illustrated embodiment. For example, the hydraulic motors can be replaced by electric motors and the number and arrangement of the nozzles can be chosen to suit particular working conditions.

We claim:

1. An apparatus for agitating the contents of storage tanks comprising a housing adapted to be immersed in the contents of the tank, an impeller and an impeller casing extending beyond an end of the housing, respective variable drive means for rotating the impeller and the impeller casing located within the housing, an inlet to the impeller, and a plurality of radially directed outlets in the casing whereby rotation of the impeller effects circulation of the contents from the inlet to the outlets and rotation of the casing causes the discharge at the outlets to agitate the contents of the tank.

2. An apparatus according to claim 1 including a partition wall within the housing to enclose and isolate the respective drive means from the contents of the tank.

3. An apparatus according to claim 1 including pressure fluid flow paths to provide barriers against ingress of the contents into the interior of the housing.

4. An apparatus according to claim 3 including an associated carriage located outside the tank and supporting pressure fluid supply means and power means for the respective drive means.

5. An apparatus according to claim 4 in which the respective drive means comprise hydraulic motors.

* * * * *